US006181233B1

(12) United States Patent
Hofsäss et al.

(10) Patent No.: US 6,181,233 B1
(45) Date of Patent: Jan. 30, 2001

(54) TEMPERATURE-DEPENDENT SWITCH

(75) Inventors: Marcel Hofsäss, Neuenbürg; Michael Becher, Althengstett; Edwin Güttinger, Königsbach, all of (DE)

(73) Assignee: Thermik Geratebau GmbH, Pforzheim (DE)

( * ) Notice: Under 35 U.S.C. 154(b), the term of this patent shall be extended for 0 days.

(21) Appl. No.: 09/289,822

(22) Filed: Apr. 12, 1999

(30) Foreign Application Priority Data

Apr. 16, 1998 (DE) ..... 198 16 809

(51) Int. Cl.[7] ..... H01H 37/14; H01H 37/54

(52) U.S. Cl. ..... 337/377; 337/333; 337/343; 337/53; 337/77

(58) Field of Search ..... 337/298, 14, 102, 337/103, 104, 16, 36, 97, 333, 343, 377, 390, 53, 77, 100

(56) References Cited

U.S. PATENT DOCUMENTS

| | | | | |
|---|---|---|---|---|
| 2,753,421 | * | 7/1956 | Mertler | 337/347 |
| 3,265,839 | * | 8/1966 | Johnson | 337/91 |
| 3,308,255 | * | 3/1967 | Faggiano | 337/367 |
| 4,399,423 | * | 8/1983 | Nield | 337/102 |
| 4,528,540 | * | 7/1985 | Stiekel et al. | 337/102 |
| 4,620,175 | * | 10/1986 | Karr et al. | 337/343 |
| 4,862,132 | * | 8/1989 | Hollweck | 337/102 |
| 5,233,325 | * | 8/1993 | Takeda | 337/107 |
| 5,268,664 | * | 12/1993 | Givler | 337/380 |
| 5,309,131 | * | 5/1994 | Hofsass et al. | 337/102 |
| 5,428,336 | * | 6/1995 | Smith et al. | 337/365 |
| 5,615,072 | * | 3/1997 | Hofsass et al. | 361/24 |

FOREIGN PATENT DOCUMENTS

| | | | | |
|---|---|---|---|---|
| 3320730A1 | * | 7/1984 | (DE) . | |
| 2849584C2 | * | 6/1989 | (DE) . | |
| 8617033 U | * | 6/1993 | (DE) . | |
| 2015823 | * | 6/1982 | (GB) . | |
| 411195364 | * | 7/1999 | (JP) | H01H/61/02 |

* cited by examiner

*Primary Examiner*—Leo P. Picard
*Assistant Examiner*—Anatoly Vortman
(74) *Attorney, Agent, or Firm*—Harness, Dickey & Pierce, P.L.C.

(57) ABSTRACT

A temperature-dependent switch has two connection electrodes mounted on an insulating support as well as a switching mechanism that, as a function of its temperature, creates an electrically conductive connection between the two connection electrodes. Also provided is a resistance element that is connected to the two connection electrodes electrically parallel to the switching mechanism and is inserted into the insulating support perpendicular to the connection electrodes, so that it sits inside the insulating support and is retained by it.

7 Claims, 2 Drawing Sheets

TEMPERATURE-DEPENDENT SWITCH

BACKGROUND OF THE INVENTION

1. Field of the Invention

The present invention is related to a temperature-dependent switch having two connection electrodes mounted on an insulating support, a switching mechanism that as a function of its temperature makes an electrically conductive connection between the two connection electrodes, and a resistance element that is connected to the two connection electrodes electrically parallel to the switching mechanism.

2. Related Prior Art

A switch of this kind is known from DE 21 13 388 A.

The known switch is a thermostat for protecting an electrical device, the switch being connected electrically in series with the device to be protected and in thermal contact with the device.

The two connection electrodes are planar metal parts of which one carries a fixed countercontact and the other a bimetallic element on whose free end sits a movable countercontact coacting with the fixed countercontact. The two metal parts are arranged one above another, and clamp between them a PTC resistor that, with interposition of a spring, is in electrical contact with both connection electrodes.

This configuration made up of insulating support, metal parts with fixed and movable countercontacts, and PTC resistor is slid into a housing, whereupon the housing opening is encapsulated with a sealing compound.

If the temperature of the device being protected exceeds the response value of the bimetallic element, the latter lifts the movable countercontact away from the fixed countercontact, thereby interrupting the supply of current to the device. A small residual current now flows through the PTC resistor arranged parallel to the switching mechanism thus constituted, developing sufficient heat to hold the switching mechanism open; this function is called "self-holding."

A disadvantage with the known switch is that the PTC resistor is mechanically retained only when the switch is completely assembled, making assembly of this switch quite complex. Replacement of the PTC resistor is not possible.

A further self-holding temperature-dependent switch is known from DE 43 36 564 A1. This known switch comprises a bimetallic switching mechanism arranged in an encapsulated housing. The housing is arranged on a support plate on which conductor paths and resistors are provided. A PTC resistor, which is soldered parallel to the switching mechanism with external connectors, is provided outside the housing on the support.

A disadvantage of this switch is that it not only requires a relatively large number of components, but also has large dimensions.

SUMMARY OF THE INVENTION

In view of the above, it is an object of the present invention to improve the temperature-dependent switch mentioned at the outset in such a way that it can be assembled economically and easily; preferably, replacement of the resistance element is to be possible.

According to the present invention, this object is achieved in the case of the switch mentioned at the outset in that the resistance element is inserted into the insulating support perpendicular to the connection electrodes, so that it sits inside the insulating support and is retained by it.

The object underlying the invention is completely achieved in this fashion.

Specifically, the inventors of the present application have recognized that a surprisingly simple switch can be created if the resistance element is not arranged in sandwich fashion between the connection electrodes or on a separate support next to the switch, but rather is directly retained internally in the insulating support. The switch can then first be completely fabricated before the resistance element is then inserted subsequently into the insulating support. If the resistance element is dispensed with, the switch does not have the self-hold function, but in many applications this is sufficient.

If, on the other hand, the switch is to be equipped with a self-hold function, all that is necessary is to insert the resistance element. It is now possible, with one and the same basic switch, to selectably insert different resistance elements in order to adapt to different utilization conditions in terms of operating current and response temperature. The result is a great advantage in terms of production, since the switch as such can be prefabricated in large quantities so that later the various resistors merely need to be added. This possibility was also offered by the switch known from DE 43 36 564 A1 cited above, but there the subsequent installation of the resistance element was very complex. In contrast, DE 21 13 388 A, also mentioned above, does not allow this partial production of the switch; the PTC resistor, clamped between the connection electrodes in the interior of the housing, needed to be delivered in the correct configuration during production itself.

Altogether the new switch thus offers the advantage that the basic switch can be prefabricated and then later equipped, to order, with a resistor. Since it is thereby possible to manufacture the basic switch in a single production operation in much greater quantities, specifically because the specialization of the switch is not defined until later, the overall result is also a decrease in production costs, since the lot size for production of the basic switch can be much larger than in the case of the generic switch.

In an improvement, it is preferred if the two connection electrodes comprise planar metal parts which are arranged in one plane; and if the resistance element rests on the metal parts.

This feature is also advantageous in terms of assembly engineering, since the electrical connection between the resistance element and the connection electrodes is accomplished via the geometrical arrangement of the resistance element on the connection electrodes, where they are held by the insulation element.

It is further preferred if the two connection electrodes are equipped with contact ends which are arranged at a distance one behind another in the longitudinal direction of the switch; and if the resistance element spans the distance.

This feature is also advantageous in terms of assembly engineering, since it makes possible, for example, a temperature-dependent switching mechanism in which a bimetallic spring is mounted on the one contact end and carries on its other end a movable countercontact which coacts with a fixed countercontact mounted on the other contact end. The resistance element is then arranged, so to speak, geometrically and electrically in parallel with this bimetallic spring.

It is further preferred if the insulating support is equipped with projections which clamp the resistance element between them and press it onto the connection electrodes.

This feature is also advantageous in terms of assembly engineering; the resistance element needs be pressed, so to speak, only from outside between the projections, where it is then simultaneously held by their spring effect and pushed onto the connection electrodes. Later replacement of the resistance element is, however, also possible as a result; this can be advantageous under certain utilization conditions.

In general, it is also preferred if the one connection electrode carries a fixed countercontact and the other a bimetallic element on whose free end sits a movable countercontact coacting with the fixed countercontact.

The advantage with this feature is that a technically very simple switching mechanism is used, in which the operating current flows through the bimetallic element itself so that a further spring part can be dispensed with.

It is further preferred if the resistance element is a PTC block.

The advantage here in terms of assembly engineering is that an easily handled and easily contacted PTC block is used, the outer surfaces of which can be configured in known fashion as terminals.

Further advantages are evident from the description and the appended drawings. It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is shown in the drawings and will be explained in more detail in the description below. In the drawings.

DETAILED DESCRIPTION OF A PREFERRED EMBODIMENT

Figure 1:
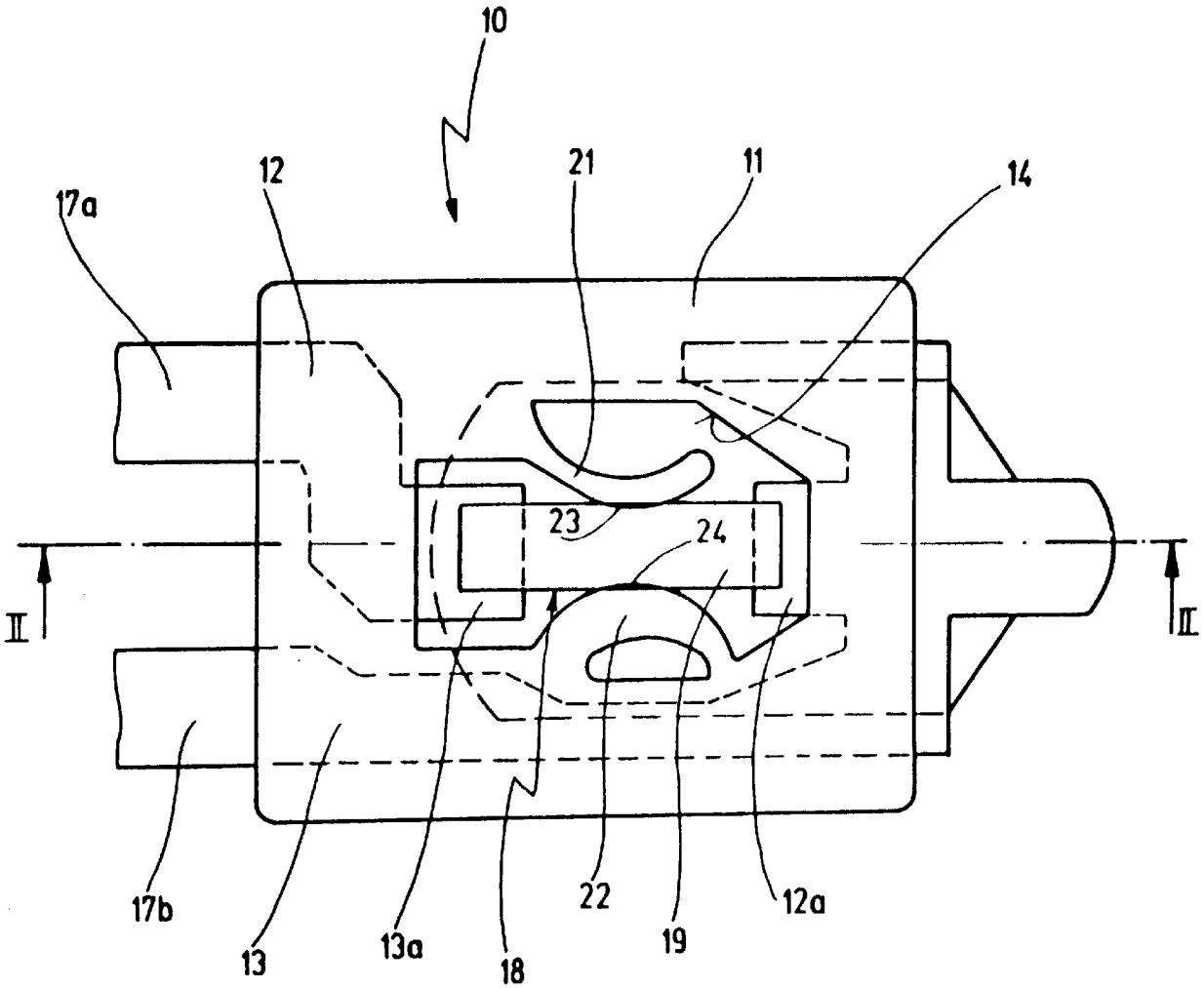
FIG. 1 shows a plan view of a schematically shown temperature-dependent switch, with connection electrodes indicated using dashed lines.

In FIG. 1, 10 designates a temperature-dependent switch which comprises an insulating support 11 on which two connection electrodes 12, 13, shown with dashed lines in FIG. 1, are mounted. Connection electrode 13 is L-shaped and connection electrode 12 is Z-shaped, so that they face toward one another with their contact ends 12*a*, 13*a* in the longitudinal axis of switch 10. An opening 14, open toward the top, into which contact ends 12*a*, 13*a* project so that they are accessible from above, is provided in insulating support 11.

The two connection electrodes 12, 13 comprise planar metal parts which are arranged in a plane indicated as 15, next to one another to the left (in FIG. 1) of switch 10, and one behind another in the longitudinal direction of switch 10 in the region of opening 14. The two contact ends 12*a*, 13*a* are at a distance from one another, indicated as 16, in the longitudinal direction of switch 10.

By way of their external terminals 17*a*, 17*b* located outside insulating support 11, connection electrodes 12, 13 and thus switch 10 are electrically connected to a device to be protected.

Resting on connection electrodes 12, 13, or more precisely on their contact ends 12*a*, 13*a*, is a resistance element 18 which in the embodiment shown is a PTC block 19 that spans distance 16.

Figure 2:
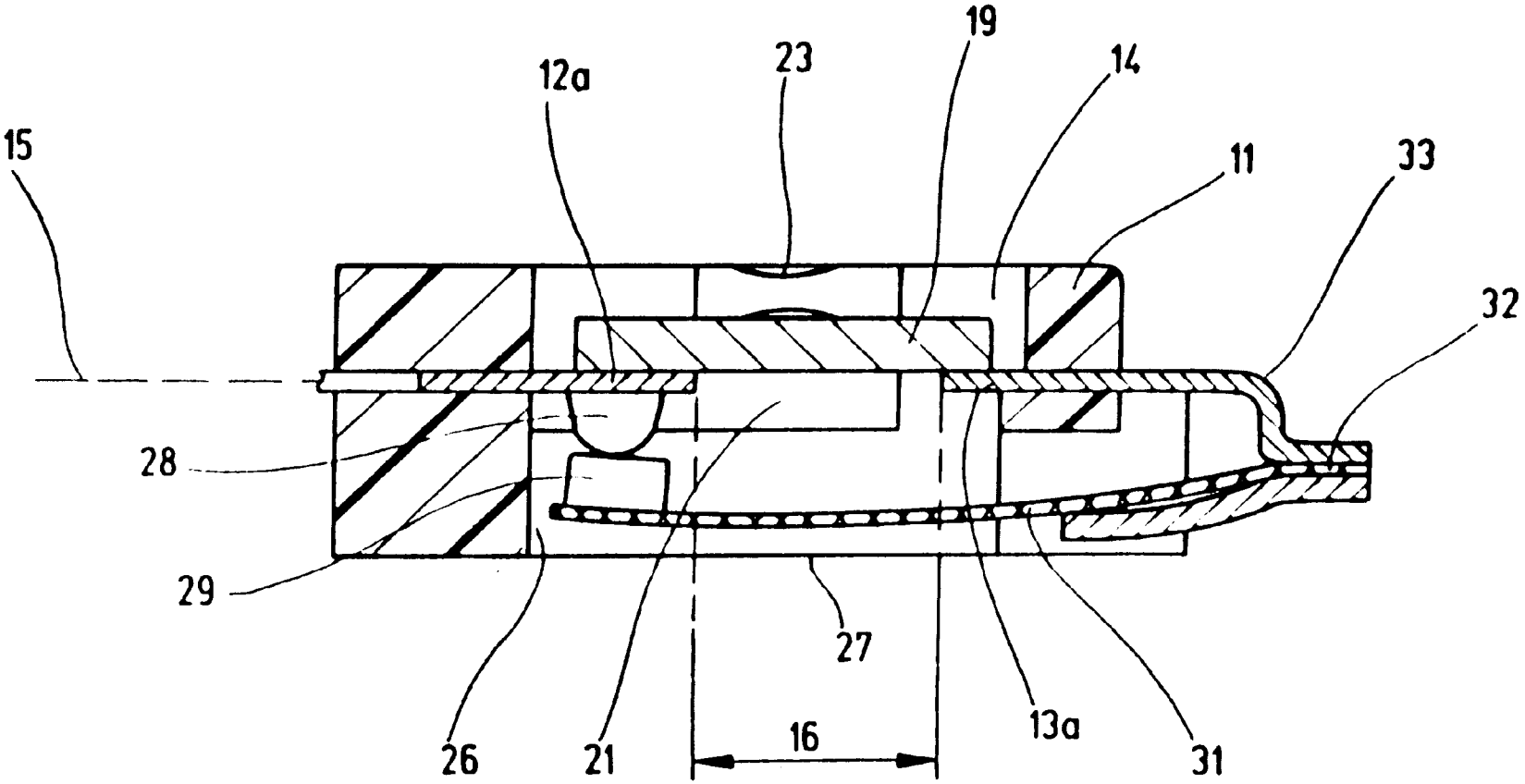
FIG. 2 shows a sectioned representation of the switch along line II—II of FIG. 1.

In opening 14, insulating support 11 has two sickle-shaped projections 21, 22 which extend perpendicular to the drawing plane of FIG. 1, i.e. in the drawing plane of FIG. 2. Projections 21, 22 clamp PTC block 19 between them, and overlap it with respective tapered transverse projections 23, 24, thereby pressing PTC block 19 onto connection electrodes 12, 13. PTC block 19 is pressed, from above in FIG. 1, between projections 21, 22, which deflect outward so that PTC block 19 comes to rest against contact ends 12*a*, 13*a*; transverse projections 23, 24 push PTC block 19 downward in FIG. 2, thus creating good electrical contact with connection electrodes 12, 13.

It is evident from the sectioned representation of FIG. 2 that a cavity 26, in which a temperature-dependent switching mechanism 27 is arranged, is provided in insulating support 11 beneath opening 14. Into this cavity, contact end 12*a* projects from the left, and contact end 13*a* from the right. Connection electrode 12 therein carries at its contact end 12*a* a fixed countercontact 28 which coacts with a movable countercontact 29 that is arranged at a free end of a bimetallic spring 31. At its other end 32, bimetallic spring 31 is joined to a bent part 33 of connection electrode 13.

In the position shown in FIG. 2, bimetallic spring 31 is in its low-temperature position in which it pushes movable countercontact 29 against fixed countercontact 28, thus creating an electrically conductive connection between the two connection electrodes 12, 13. With its connection electrodes 12, 13, switch 10 is connected in series in an electrical circuit with an electrical device to be protected, the operating current of the device being passed through connection electrodes 12, 13 and bimetallic spring 31. If the temperature of switch 10 and thus of bimetallic spring 31 then increases above the switching temperature, bimetallic spring 31 lifts movable countercontact 29 away from fixed countercontact 28, thereby interrupting the circuit so that the protected device is switched off.

A residual current nevertheless continues to flow through PTC block 19, which is arranged electrically parallel to switching mechanism 27. The residual current flowing through PTC block 19 raises the temperature directly above bimetallic spring 31, so that the latter is kept above its switching temperature and switch 10 cannot automatically close again. Only after delivery of power has been interrupted does PTC block 19 and thus also bimetallic spring 31 cool off sufficiently for switching mechanism 27 to be able to close again.

PTC block 19 can be designed differently in terms of its resistance, so that different switching temperatures can be obtained. All that is necessary to achieve this is to arrange different PTC blocks 19 between the resilient projections 21, 22 and connection electrodes 12, 13 in opening 14.

Therefore, what we claim, is:

1. A temperature-dependent switch having two connection electrodes mounted within an insulating support, a switching mechanism that as a function of its temperature makes an electrically conductive connection between the two connection electrodes, and a resistance element that is connected to the two connection electrodes electrically parallel to the switching mechanism, wherein the resistance element is inserted into the insulating support so that it sits inside the insulating support and is retained by it; and further wherein said two connection electrodes comprise planar metal parts which are arranged in one plane, and said resistance element rests inside the insulating support on the planar metal parts.

2. The switch as in claim 1, wherein the insulating support is equipped with resilient projections which clamp the resistance element between them and press it onto the connection electrodes.

3. The switch as in claim 2, wherein the one connection electrode carries a fixed countercontact and the other connection electrode a bimetallic element on whose free end sits a movable countercontact coacting with the fixed countercontact.

4. The switch as in claim 1, wherein the two connection electrodes are equipped with contact ends which are arranged at a distance one behind another in the longitudinal direction of the switch; and the resistance element spans the distance.

5. The switch as in claim 1, wherein the one connection electrode carries a fixed countercontact and the other connection electrode a bimetallic element on whose free end sits a movable countercontact coacting with the fixed countercontact.

6. The switch as in claim 1, wherein the resistance element (18) is a PTC block (19).

7. The switch as claimed in claim 1 wherein the resistance element is adapted to be inserted through an opening in said insulating support in a direction substantially perpendicular to the plane of said planar metal parts.

* * * * *